United States Patent [19]

Littlewood

[11] 4,009,786

[45] Mar. 1, 1977

[54] METHOD OF AND APPARATUS FOR HANDLING FABRIC WORKPIECES

[76] Inventor: Kenneth Joseph Littlewood, 14 Duscson Drive, Templestone 3106, Australia

[22] Filed: Nov. 12, 1975

[21] Appl. No.: 630,964

[30] Foreign Application Priority Data

Dec. 2, 1974 Australia ..... 9880/74

[52] U.S. Cl. ..... 214/8.5 C; 214/8.5 SS; 214/152; 271/18.3; 294/61

[51] Int. Cl.[2] ..... B65H 3/22

[58] Field of Search ..... 271/183, 19–21, 271/24; 214/8.5 SS, 8.5 C, 152; 221/213–216; 294/61; 270/58

[56] References Cited

UNITED STATES PATENTS

| | | | |
|---|---|---|---|
| 3,176,979 | 4/1965 | Engelmann | 271/18.3 |
| 3,386,763 | 6/1968 | Ottaway et al. | 271/18.3 |
| 3,608,890 | 9/1971 | Littlefield | 271/21 |
| 3,625,506 | 12/1971 | Rovin | 271/18.3 |

*Primary Examiner*—Robert W. Saifer
*Attorney, Agent, or Firm*—Peter J. Patane; Joseph G. Denny, III

[57] ABSTRACT

A device for transferring a preselected number of sheets of material from several stacks and depositing the sheets at a location. The device comprises a pick-up head which is adjustable on selection to pick up from a first location one or two sheets, pick up one or two sheets from a second location and deposit the assembly of sheets at another location or feed same through a processing machine.

11 Claims, 9 Drawing Figures

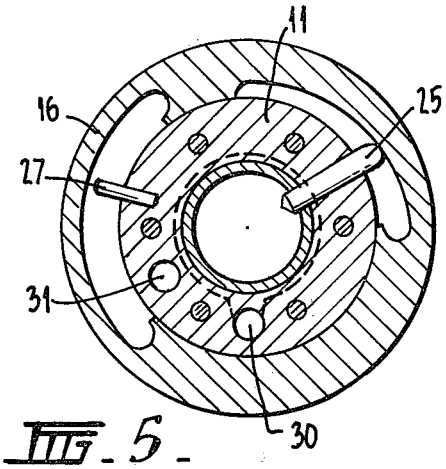
FIG. 5.
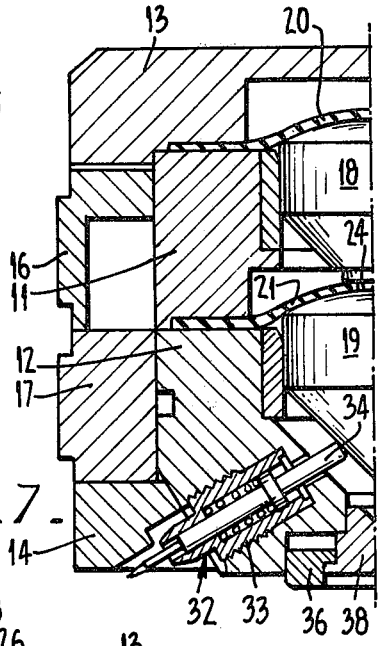
FIG. 7.
FIG. 6.
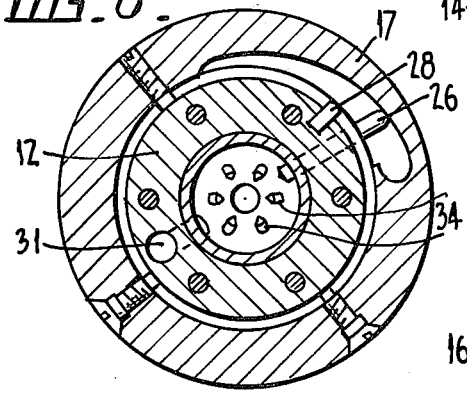
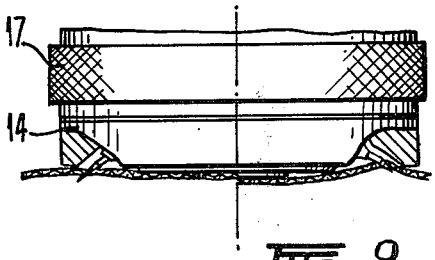
FIG. 9.
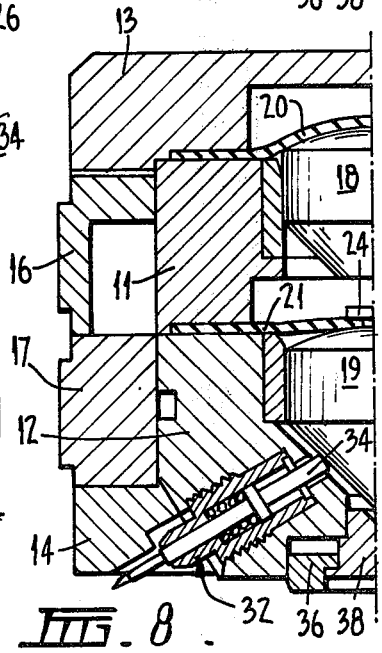
FIG. 8.

METHOD OF AND APPARATUS FOR HANDLING FABRIC WORKPIECES

BACKGROUND OF THE INVENTION

This invention relates to apparatus for handling fabric work pieces and in particular but not exclusively relates to apparatus for feeding, transferring and stacking limp fabric work pieces to and through automatic or semi-automatic process machines such as, for example, garment processing machines.

The manufacture of clothing and other products from cloth or like flexible sheet material can be achieved by sewing and other processes applied to pre-cut work pieces usually delivered in stacks to the processing machines. The manufacture of other articles such as drapery, footwear, soft furnishings, auto seat covers and trims, and the like can also be achieved from assemblies of sewn or bonded pieces cut from webs of material. Normally, the productivity of the industries manufacturing these products is limited by the ability of operators to pick up and gain control of the individual pieces and present them in matched assemblies to adjustable process machines.

Process machines are available which are designed to perform particular operational functions such as control of the direction of sewing, positioning of work pieces, machine stop/start and other known desired functions in the manufacture of an article from fabric or like flexible material.

In order to feed these sewing and other machines, various devices have been proposed with the object of gaining control of the material and separating individual pieces from a cut stack of pieces. In the past, methods of operation used for feeding such machines have met with varying degrees of success due to the porosity and handling variables of the material and the comparative limp nature of fabric materials, and difficulties of separation from following pieces in a stack presents additional problems.

A number of devices have been designed in an attempt to solve fabric feeding problems. One type of known device relies upon adhesion to a sticky surface; another utilizes inwardly closing prongs in the manner of a chuck; another uses the needles of textile card cloth to pinch the surface ply; another uses the uniformly angularly oriented needles of card cloth for unidirectional frictional contact and pick-off; and yet another uses air suction members. Having gained control of the top piece of cloth, various means have been used to separate the piece without displacement of the other pieces in a stack, since any such movement would spoil the accuracy of engagement of the subsequent pieces and thus positioning would be inaccurate.

These devices have proved successful but are limited to feeding a single sheet, or a preselected number of sheets of the same shape, between two locations only and therefore do not solve the problem of the fabric or clothing manufacturer of providing a device capable of assembling a number of sheets of various shapes from several locations for presentation in the desired alignment and sequence to a process machine in an automatically or semi-automatically controlled operation. A further important requirement in the fabric processing industry which can not be performed successfully by these prior devices is the facility to selectively disengage at a desired location one or some of the engaged sheets during the assembly operation.

It is an object, therefore, of the present invention to overcome the known fabric feeding problems by providing apparatus which incorporates a device or devices which first engage the first sheet or sheets of a stack, and while still maintaining control of the first sheet or sheets can engage with precise positioning a series of additional sheets and manipulate each in sequence in order to assemble and control the assembly of sheets or work pieces, either to present them to a process machine or control them through a normal sewing or other bonding machine. Eventually a stack of the sewn or processed assemblies can be made or the device can be used to maintain control and transfer the assemblies to other machines.

Thus this invention is capable of controlling flexible material including fabric or limp material through the manufacturing operations of sewing, pressing, cutting, fusing, creasing, printing, and so on, so that clothing and like fabric articles can be automatically manufactured, without manual assistance. The mechanisms necessary to sense and control the transporting and positioning movements of the device during assembly processing of the sheets or work pieces are well known in prior art.

It is a further object of the invention to provide a device having the ability to engage a first sheet or sheets, and then to pick up and separate additional sheets in conjunction and in series, and disengage or re-engage the last sheet or any number of the sheets picked up, while retaining the first engaged sheet or sheets thereon.

SUMMARY OF THE INVENTION

The above objects are achieved by providing a pick-up device for assembling a preselected number of sheets from several stacks thereof comprising a body member having a sheet engaging surface, a plurality of pointed members slidably mounted in said body member and adapted to extend outwardly at an acute angle to and beyond said engaging surface for sequential engagement in one or more sheets in each stack so as to provide a predetermined assembly of sheets from said stacks for transfer to a processing station, and actuating means in said body member adjustably movable with respect to said pointed members for limiting the extension of said pointed members so as to control the number of sheets engaged in each stack. The term "sheet" herein is intended to include various cut shapes of fabric or cloth plies, leather, vinyl coated materials and the like.

Preferably, the pointed members are spring biassed inwardly in the body member and the actuating means comprise one or more fluid pressure actuated tapered plunger means the extent of movement of which is controlled by adjustable cam means. Pressure pad means biassed outwardly from the sheet engaging surface of the body member may be provided to assist in the penetration of the pointed members in the sheets and to ensure separation of the gripped sheet or sheets from the sheets left in the stack.

The adjustable cam means preferably comprise a cam ring or rings adjustably rotatable on the body member of the device for controlling the movement of radially extending pin members engageable with the actuating plunger means and acting as stop members to limit the movement of the actuating plunger means during the extension of the pointed members.

The fluid pressure actuating plungers may be controlled to allow partial retraction of the pointed members during an operation to release only one or some of the lower gripped sheets.

The device of the invention or a plurality of such devices may be mounted on a rigid or flexible support linkage or the like carried by a transfer machine designed and programmed to suit any desired assembling and processing operation.

BRIEF DESCRIPTION OF THE DRAWINGS

FIG. 5 is a section along the line 5—5 of FIG. 4 in the direction of the arrows;

FIG. 6 is a section along the line 6—6 of FIG. 4 in the direction of the arrows;

FIG. 7 is a half cross-section of the device with the upper plunger in its operative position;

FIG. 8 is a half cross-section of the device with the lower plunger in its operative position; and FIG. 9 is a schematic view showing on the left side the engagement of the device with a sheet and on the right side the position of a sheet after pick-up from a stack.

DESCRIPTION OF THE PREFERRED EMBODIMENT

Figure 1:
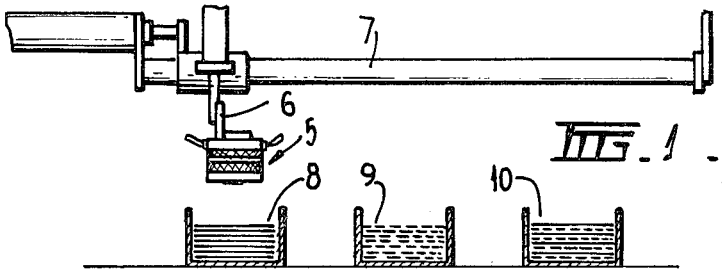
FIG. 1 is a schematic layout of a simple transfer machine incorporating a pick-up device of the present invention.
Figure 2:
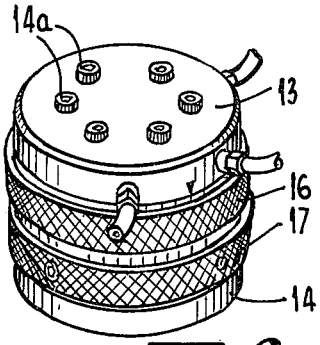
FIG. 2 is a perspective view of the device from above.
Figure 3:
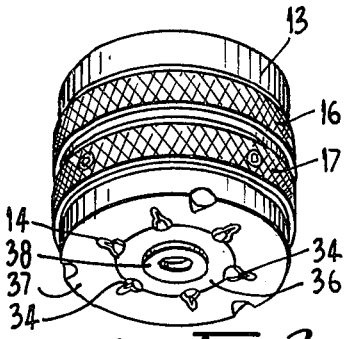
FIG. 3 is a perspective view of the device from below.
Figure 4:
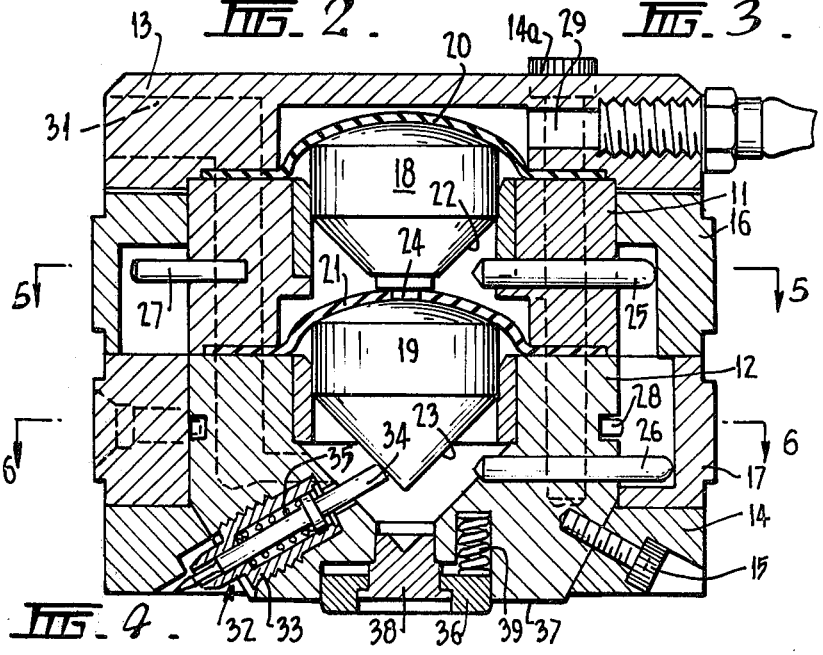
FIG. 4 is a cross-section of the device in its inoperative position.

Referring to the drawings and in particular FIG. 1, the pick-up device 5 is shown incorporated in a simple transfer machine and mounted on a movable vertical support 6 which in turn is mounted for controlled movement on a horizontal support 7. Stacks 8 and 9 contain sheets or plies of material which are picked up by the device 5 in any particular sequence and deposited on stack 10 or the reverse operation may apply.

Referring to FIGS. 2 to 8 the pick-up devices as illustrated in this embodiment comprises a body member having two parts 11, 12 held together with top plate 13 by screws 14*a*. Bottom ring guard 14 is secured to lower body part 12 by screws 15. Rotatable cam rings 16 and 17 are located on the body member between top plate 13 and bottom ring 14 and are provided with suitable setting marks around their outer periphery, and fastening screws or like locking means to secure the rings in their pre-set positions.

Plunger members 18 and 19 are located for reciprocal movement in the upper and lower body parts and diaphragms 20 and 21 are associated therewith and secured between the top plate and the upper body part and the two body parts respectively. Both plungers 18 and 19 are provided with tapered lower surfaces 22 and 23 and lower plunger 19 is connected to diaphragm 21 by pin member 24 adapted to abut against the bottom end of plunger 18 in certain positions of the plungers.

Pin members 25 and 26 are located in the body parts for radial movement on rotation of cam rings 16 and 17 and stop pins 27 and 28 are provided on the body parts to limit the rotational movement of the cam rings.

Pressure air ports 29, 30 and 31 are provided in the device, port 29 being in communication with the upper surface of the diaphragm 20, port 30 is in communication with the upper part of diaphragm 21 and port 31 is in communication with the space below the lower plunger 19.

Needle cartridge assemblies 32 are located in equispaced circular arrangement in lower body part 12, each cartridge assembly consisting of a locating guide bush 33, needle 34 and spring 35. Needles 34 extend outwardly at an angle of approximately 30° to the sheet engaging face 37 of the lower body part. An annular pressure pad member 36 is located in the sheet engaging face 37 of lower body part 12 and held therein for limited movement by retainer member 38. Pressure pad 36 is biassed outwardly of face 37 by springs 39.

In a typical mode of operation with the transfer machine of FIG. 1, the pick-up device is moved above stack 8 and engaged under predetermined pressure with the sheets in stack 8 so that pressure pad 36 is pushed up into lower body part 12 against the pressure of springs 39. Pressure air is then applied through port 29 and diaphragm 20 pushes down against upper plunger 18 which contacts pin member 24 of lower plunger 19 pushing lower plunger 19 downwardly against the annular array of needles 34 extending the needles a predetermined distance. The needles enter interstices of the selected sheet or sheets of fabric material at an acute angle of approximately 30° as shown in the left hand side of FIG. 9 and the predetermined distance of penetration of the needles is determined by the setting of cam ring 16 acting through pin member 25 engaging against the tapered lower surface 22 of upper plunger 18. In some applications where the sheets consist of thin cloth plies the needles may be extended before the device is engaged with the stack so that the needle points act as barbs.

As the device is lifted from stack 8 biassing springs 39 force pressure pad 36 outwardly from the lower face 37 of body part 12 and stretches the sheet or sheets of material between the needles to allow full penetration by the needles to provide efficient pick up and transporting of the sheet or sheets and to ensure separation from the remaining sheets in the stack. This action of the pressure pad also allows a setting of the needle extension in some applications whereby the needles engage in the first instance only partially in the sheet to ensure that following sheets are not engaged and as the device is lifted from the stack the pressure pad acts to drive the needles more deeply into the engaged sheet. The right hand side of FIG. 9 shows a sheet picked up ready for transfer to another location and readily illustrates the diminished area of contact of the engaged sheet which allows easier separation from the stack.

The sheet or sheets picked up from stack 8 are now moved to stack 9 and the cycle is repeated and an additional sheet or sheets picked up by applying air pressure through port 30. Air enters through port 30 into the space above diaphragm 21 pushing diaphragm 21 and in turn plunger 19 downwardly until it engages cam operated pin member 26 during which time the needles are further extended to pick up the additional sheet or sheets.

The device is moved away from stack 9 in the manner previously described and the engaged sheets are moved to stack 10 where they may be released. Alternately the engaged assembly of sheets on the device may be moved directly to and/or through a process machine. Although only two pick up operations are described in this embodiment it will be obvious to those versed in the art that the extension of the needles can be controlled to provide more than two preselected extensions of the needles.

Release of the engaged sheets is effected by connecting ports 29 and 30 to exhaust and this allows plungers 18 and 19 to move upwardly and allow the needles 34 to retract inwardly under pressure of springs 35 in the cartridge assemblies 32. To ensure that plungers 18 and 19 move upwardly, pressure air is applied to port 31 and once the needles retract the engaged sheets are totally released. The pressure air supplied through port 31 may carry a lubricant for lubricating the needles and the surface of plunger 19. The outward movement of pressure pad 36 further assists in the release of the engaged sheets.

If pressure air is maintained at port 29 the upward travel of plunger 19 is limited so that the needles retract only far enough to release the lower sheet or sheets.

Although the above described embodiment has for the sake of clarity, been described in relation to use on a simple transfer machine with one device, it will be appreciated that a number of devices can be mounted on a transfer machine in various configurations dictated by the shape of the material sheets and the purpose for which they are to be used. For example it is an important operation in the manufacture of clothing to be able to stretch or contract a part in relation to another and this may be referred to as introducing fullness as when two corresponding parts are cut to different lengths. This is necessary when inserting sleeves in men's jackets. In such an operation the devices may be mounted on flexible arms or the like or connected by springs and manipulated to achieve the desired stretching or contracting when assembling the parts from their stacks for presentation to the processing machine.

Again the pick-up devices of the invention may be conveniently mounted in or on a strip of flexible material such as a plastic material and can be operated together to permit the engaged cloth to drape along a straight or curved line as a preliminary to a folding or creasing operation. Furthermore, this arrangement can be made as a contoured strip which can engage, for example, the edge of a coat front and then be deflected into another configuration to match a coat facing, and thus can be used to produce tailored parts which otherwise require a skilled machinist.

Certain materials are manufactured by processes which result in an undesirable frictional engagement or bonding when two or more sheets are laid on top of each other. Vinyl coated material and circular knit interlock material are examples. In these circumstances a pair of such sheets may be engaged from one side by the pick-up device, moved to another location where a second pick-up device engages the lower sheet and on further adjustment of the needle penetration of the first device so as to engage one sheet only, the devices can be moved apart to separate the sheets. Heretofor, such partially bonded or frictionally engaged sheets could not be mechanically manipulated in transfer operations.

The pick-up devices of the invention may be advantageously used for engaging materials which have a surface which would be permanently marked by the penetration of the needles. This is accomplished by application of the needles to the back surface of the sheet, and by fine adjustment of the needle extension the sheet may be picked up with the needles only partially embedded in the material. This is particularly advantageous in processes used for manufacturing shoe uppers, leather or vinyl seat covers, auto interior trims and the like.

In some processing operations such as the production of products from stiff or semi-rigid materials such as leather, the upper diaphragm, plunger and cam setting ring of the above described embodiment can be omitted so that only one extended position of the needles can be selected and two such devices can be used in tandem. The first device could be adjusted to pick up one or more sheets and the second device adjusted to make the second engagement of two or more sheets. The total cycle time would thus be reduced as only two positions would be required.

Although the pick-up device described above is shown in cylindrical form, it will be appreciated that the device may be of other desired shapes, such as square, triangular or of elongated form and in the latter configuration the plungers may be constructed in bar-like form with rows of needles extending from both sides of the device. Alternately cams may be substituted for the plungers.

The various features and advantages of the invention are thought to be clear from the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

What I claim is:

1. A pick-up device for assembling a preselected number of sheets from several stacks thereof comprising a body member having a sheet engaging surface, a plurality of pointed members slidably mounted in said body member and adapted to extend outwardly at an acute angle to and beyond said engaging surface for sequential engagement with at least one sheet in each stack so as to provide a predetermined assembly of sheets from said stacks for transfer to a processing station, and actuating means in said body member adjustably movable with respect to said pointed members for limiting the extension of said pointed members so as to control the number of sheets engaged in each stack.

2. A pick-up device in accordance with claim 1 wherein said actuating means comprises at least one fluid pressure actuated tapered plunger means the extent of movement of which is controlled by adjustable cam means.

3. A pick-up device in accordance with claim 1 wherein said pointed members are annularly arranged in said sheet engaging surface of said body member and are spring biassed inwardly in the body member and engageable at their inner ends by said actuating means.

4. A pick-up device in accordance with claim 3 which further includes annular pressure pad means biassed outwardly from said sheet engaging surface of the device and located within said annular array of pointed members, said pressure pad means being operable to assist in the penetration of the pointed members with engaged articles as the device is moved from a stack and to assist in the separation of the engaged at least one sheet from the sheets left in the stack.

5. A pick-up device in accordance with claim 1 wherein the limitation of extension of said pointed member is controlled by a cam ring on said body member engageable with a radially movable pin member in said body member which in turn is engageable with said actuating means so as to limit movement thereof towards the said sheet engaging surface.

6. A pick-up device in accordance with claim 1 wherein said pointed members comprise an annular array of needles spring biassed inwardly in the body member and engageable at their inner ends by said actuating means, and said actuating means comprise first and second plunger members slidably mounted in said body member on a common axis and having associated diaphragm members at the plunger ends remote from said sheet engaging surface defining three chambers separately connected to a fluid pressure source whereby pressure selectively applied to one of said chambers moves the first plunger member into engagement with the second plunger member which in turn engages with and extends said pointed members, pressure applied to a second of said chambers acts on said second plunger member to further extend the pointed members, and pressure applied to the third chamber assists in moving said plunger members in a direction away from said pointed members, the opposite ends of the plunger members having inwardly tapered surfaces adapted to be engaged by radially extending pins so as to limit the movement of the plungers against said pointed members, the extension of said pin members being controlled by adjustable cam ring members mounted on said body member.

7. A pick-up device in accordance with claim 6 and further including annular pressure pad means biassed outwardly from said sheet engaging surface of the device and located within said annular array of pointed needles, said pressure pad means being operable to assist in the penetration of the pointed members with engaged articles as the device is moved from a stack and to assist in the separation of the engaged at least one sheet from the sheets left in the stack.

8. The method of transferring a preselected number of sheets of material from several locations to a processing machine including the steps of picking up a preselected number of sheets from a stack of cut materials with a device comprising a body member having a sheet engaging surface, a plurality of pointed members slidably mounted in said body member and adapted to extend outwardly at an acute angle to and beyond said engaging surface for sequential engagement with said preselected number of sheets in each stack so as to provide a predetermined assembly of sheets from said stacks for transfer to a processing station, and actuating means in said body member adjustably movable with respect to said pointed members for limiting the extension of said pointed members so as to control the number of sheets engaged in each stack and, picking up at least one further sheet from at least one further stack, and depositing said assembly of sheets at a further location.

9. A pick-up device for lifting and removing at least one sheet from a stack thereof at one station in which said sheets are arranged in horizontal planes comprising a body member having a sheet engaging surface, a plurality of pointed members slidably mounted in said body member and adapted to extend outwardly at an acute angle with a horizontal plane and beyond said engaging surface for engagement with at least one of said sheets of said stack for lifting at least one of said sheets from said stack and for transfering therefrom, and a pad movable toward and away from said sheet engaging surface of said device and located between at least two of said pointed members, said pad being movable toward the uppermost sheet of said stack for assisting in the penetration of the pointed members of at least one of said sheets as said pick-up device is lifted away from said stack and assisting in the separation of at least one of said sheets from the remainder of the sheets left in said stack.

10. The combination recited in claim 9 and further including means for moving said pick-up device vertically into and out of engagement with said stack and away from said stack to another station.

11. The method of lifting a preselected number of sheets from a stack of sheets with a pick-up device comprising pressing said pick-up device against said stack of sheets and entering with pointed needles which extend at an angle to the plane of the uppermost sheet a predetermined distance into at least the uppermost sheet of said stack of sheets, stretching away from said pointed needles the portion of said preselected number of sheets which are between at least two of said needles, and lifting the pick-up device and separating said preselected number of sheets from the remainder of the sheets of the stack of sheets, transporting said preselected number of sheets to a position above a second stack of sheets, lowering the pick-up device and said preselected number of sheets upon said second stack of sheets, pressing said pick-up device against said second stack of sheets, entering a predetermined distance through the preselected number of sheets from said first stack of sheets and into at least the uppermost sheet of said second stack of sheets, stretching away from said pointed needles the portions of said preselected number of sheets from said first and second stacks of sheets between at least two of said needles, and lifting the pick-up device and separating said preselected numbers of sheets from the remainder of the sheets of the second stack of sheets.

* * * * *